US010689992B2

(12) United States Patent
Kohn et al.

(10) Patent No.: US 10,689,992 B2
(45) Date of Patent: Jun. 23, 2020

(54) AERODYNAMIC LINK IN PART OF A TURBINE ENGINE

(71) Applicant: Safran Aircraft Engines, Paris (FR)

(72) Inventors: Thierry Kohn, Moissy-Cramayel (FR); Damien Cesar, Moissy-Cramayel (FR); Julien Sayn-Urpar, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 415 days.

(21) Appl. No.: 15/626,769

(22) Filed: Jun. 19, 2017

(65) Prior Publication Data

US 2017/0362946 A1 Dec. 21, 2017

(30) Foreign Application Priority Data

Jun. 20, 2016 (FR) ..... 16 55715

(51) Int. Cl.

| | |
|---|---|
| ***F01D 9/04*** | (2006.01) |
| ***F04D 29/54*** | (2006.01) |
| ***F04D 29/64*** | (2006.01) |
| ***F01D 25/16*** | (2006.01) |
| ***F01D 25/00*** | (2006.01) |

(52) U.S. Cl.

CPC ..... *F01D 9/041* (2013.01); *F01D 25/005* (2013.01); *F01D 25/162* (2013.01); *F04D 29/542* (2013.01); *F04D 29/644* (2013.01); *F05D 2240/121* (2013.01); *F05D 2240/122* (2013.01); *F05D 2260/30* (2013.01); *F05D 2260/37* (2013.01); *F05D 2260/38* (2013.01)

(58) Field of Classification Search

CPC ..... F01D 9/041; F01D 25/005; F01D 25/162; F05D 2240/121; F05D 2240/122; F05D 2260/30; F05D 2260/37; F05D 2260/38; F04D 29/542; F04D 29/644

See application file for complete search history.

(56) References Cited

U.S. PATENT DOCUMENTS

| | | | | |
|---|---|---|---|---|
| 4,989,406 | A * | 2/1991 | Vdoviak | F01D 25/162 244/117 A |
| 8,177,513 | B2 * | 5/2012 | Shim | B23P 15/04 29/889.7 |
| 8,777,577 | B2 * | 7/2014 | Schreiber | B21D 53/78 416/224 |
| 9,068,460 | B2 * | 6/2015 | Suciu | F01D 1/04 |
| 9,359,901 | B2 * | 6/2016 | Evans | F01D 25/005 |
| 2011/0255964 | A1 | 10/2011 | Clemen | |

FOREIGN PATENT DOCUMENTS

| | | |
|---|---|---|
| FR | 3 025 843 A1 | 3/2016 |
| FR | 3 028 893 A1 | 5/2016 |

* cited by examiner

*Primary Examiner* — Aaron R Eastman
*Assistant Examiner* — Adam W Brown
(74) *Attorney, Agent, or Firm* — Blank Rome LLP

(57) ABSTRACT

The invention relates to part of a turbine engine comprising two arms passing through a stream of the turbine engine, wherein each arm comprises an outer surface and an aerodynamic linking device. The aerodynamic linking device comprises fairings extending between the two arms, compressible interface means interposed between the fairings and means for retaining the fairings in place by pressure in relation to the arms, which compress the interface means.

11 Claims, 3 Drawing Sheets

AERODYNAMIC LINK IN PART OF A TURBINE ENGINE

The present invention relates to the airflow in a stream of a turbine engine.

It is known that the quality of this flow is disturbed when an element to be interposed therein needs to be maintained, once in place.

Indeed, retention by bringing elements closer requires attachment areas, such as threaded inserts.

The necessary volume of these attachment areas becomes a constraint.

For example, it may prove necessary to add bosses to a casing to fix an item of equipment to the latter.

Addition of these bosses, when the casing already exists, may impact the casting mould which must subsequently be modified.

Is it possible that the local drawing of the stream is to be reviewed.

Providing an aerodynamic link between two arms of a stream of a turbine engine may however be useful, or even necessary.

A problem therefore arose with regard to the possibility of creating an aerodynamic link between two such arms without significantly disturbing the flow of the fluid in the stream and avoiding the need to add bosses or to modify a casting mould used to manufacture all or part of the surrounding components.

A solution to this problem is proposed, which involves equipping a part of a turbine engine with an aerodynamic linking device comprising two arms passing through a stream of the turbine engine, each of which has an outer surface, wherein said aerodynamic linking device comprises:

- fairings extending between the two arms,
- compressible interface means interposed between the fairings and
- means for retaining the fairings in place by pressure in relation to the arms, which compress the interface means.

Hence, the fairings will be more rigid than the compressible interface means. Under the pressure exerted by positioning and subsequently retaining in position, the interface means will distort, though a priori not the fairings.

A solution of this kind should avoid bosses and other attachments, in particular by fastenings screwed to a casing and/or to said arms.

Moreover, use of compressible interface means will allow adaptation of the shape of these interface means to the requirements of retention and aerodynamics, by compression and distortion.

Furthermore, it will thus be possible for the fairings to extend continuously between the two arms, which will make it possible to limit surface discontinuities forming steps that disturb the flow of air in the secondary stream.

Such aerodynamic continuity will promote airflow in the steam, moreover without the necessary presence of solid components in the space between the arms. These fairings may indeed take the form of plates laterally flanking the interface means.

These fairings may extend substantially over the entire (radial) height of the stream.

Also with reference to retention of the fairings, the means for retaining in place by pressure may in particular comprise means of bringing the fairings closer to each other.

Hence, the best advantage will be obtained from the arms in holding the fairings, with the best possible aerodynamics.

The means for retaining the fairings in place can be detachable.

Preferably, these means of retention will extend in the gap which, in the stream, separates the two arms.

Thus, in order to retain the fairings, it will not be possible for there to be any proximity interference, neither with the casings nor with the arms, thereby providing a simple solution devoid of disadvantages in terms of modification of the surrounding components.

Once again with regard to retention of the fairings, two methods of installation and retention have in particular been adopted.

Firstly, a method in which, between the two arms arranged along an axis, the fairings are separated from each other by a space having a width along which some at least of said compressible interface means extend, such that bringing the fairings closer to each other transversally to said axis, via said means for bringing closer results in an axial abutment of the interface means against the arms.

Hence, advantage will be taken of the compressibility of the interface means will be utilised so that compression according to their thickness results in axial dilation, pressing them against the arms and =retaining the fairings.

The compressible interface means may have a profiled shape matching the profiles opposite the arms and the space separating them.

The interface means will distort when compressed and thus adopt their most appropriate position between the arms.

A second method provides that the compressible interface means are interposed between the fairings and the outer surfaces of the arms.

This solution avoids the interface means occupying the entire width between the two fairings.

Hence, skids borne by the fairings may be simply pressed against the arms.

Favourably, it will be avoided that the fairings added are under direct pressure, or contact (metal/metal) against the arms, as such contact may cause premature wear by friction.

Presence of the compressible interface means that this can be avoided, including in the first version; all that is necessary is that once the fairings are compressed in their state retained in relation to the arms, a space a few millimetres wide is created between the fairings and the outer surfaces of the arms.

In terms of material, the compressible interface means may favourably be made of elastically deformable material, such as an elastomer.

Since installation is performed in a relatively cold area of the turbine engine, well below 200° C., this is entirely acceptable.

Since the question addressed above of the value of improving aerodynamic performance impeded by problems of bosses and other attachments, particularly by fastenings screwed to a casing and/or the arms has been raised, particularly in cases in which it was noticed that addition of a fairing between a structuring arm of an intermediate casing and another slaving transfer arm located further downstream posed a problem, it is thus proposed that:

- wherein a first of said two arms has a leading edge and a trailing edge and belongs to an intermediate casing of the turbine engine in which it extends radially between an internal hub and an external shroud jointly delimiting a part of the secondary stream,
- and wherein a second of these two arms has a leading edge and a trailing edge and extends radially between outer and inner casings (of the fan) respectively also jointly delimiting a part of the secondary stream, wherein the second arm has a larger section than the first arm, the fairings run together flaring from the first arm to the second arm, jointly covering, at a first axial end, the trailing edge of the first arm and at a second axial end, the leading edge of the second arm.

Adaptation of shape, by deformation under pressure, of the compressible interface means, favourably combined with fairings in the form of plates, will allow this.

In addition to the part of a turbine engine equipped with the aerodynamic linking device presented above, a method for modifying an area between two arms in a stream of a turbine engine, in order to increase the aerodynamic performance of the stream, wherein each arm has an outer surface, is also concerned here, wherein the method comprises stages in which:

an aerodynamic linking device is used comprising fairings, compressible interface means and means for retaining the fairings in place by pressure in relation to the arms, the fairings are arranged so as to extend between the two arms, around a part of said outer surfaces, by interposing the compressible interface means between the fairings, and by the means of retention, tension is applied to the fairings that retains the latter in place by pressure in relation to the arms, by compressing the interface means.

Hence, in an existing turbine engine stream, it will be possible to adapt the solution according to the invention within the context of maintenance for example.

If necessary, the invention will be able to be better understood and other details, characteristics and advantages of the invention will appear on reading the description that follows given by way of non-limiting example and with reference to the accompanying drawings, in which.

Figure 4:
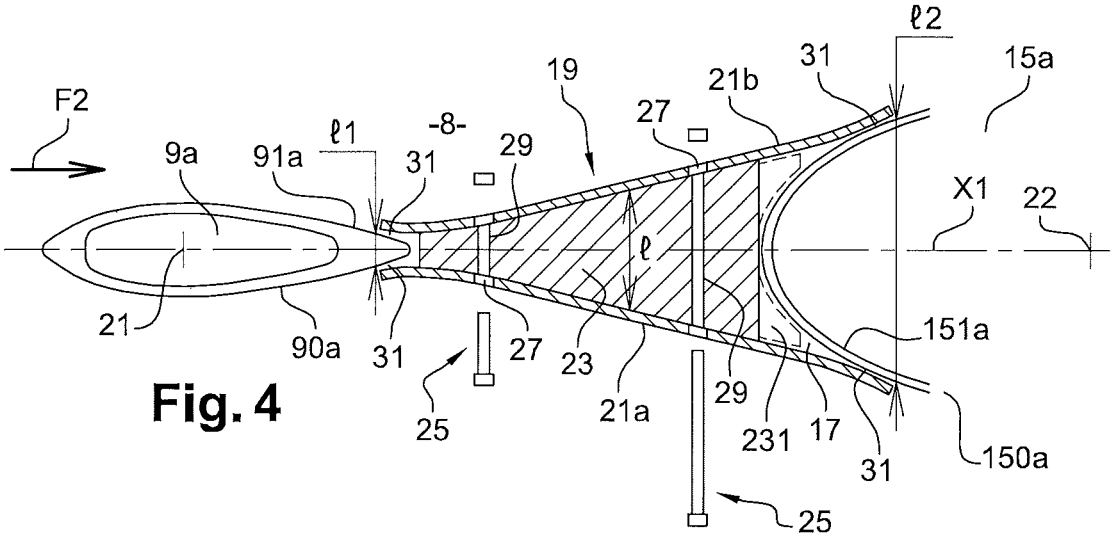
Figure 5:
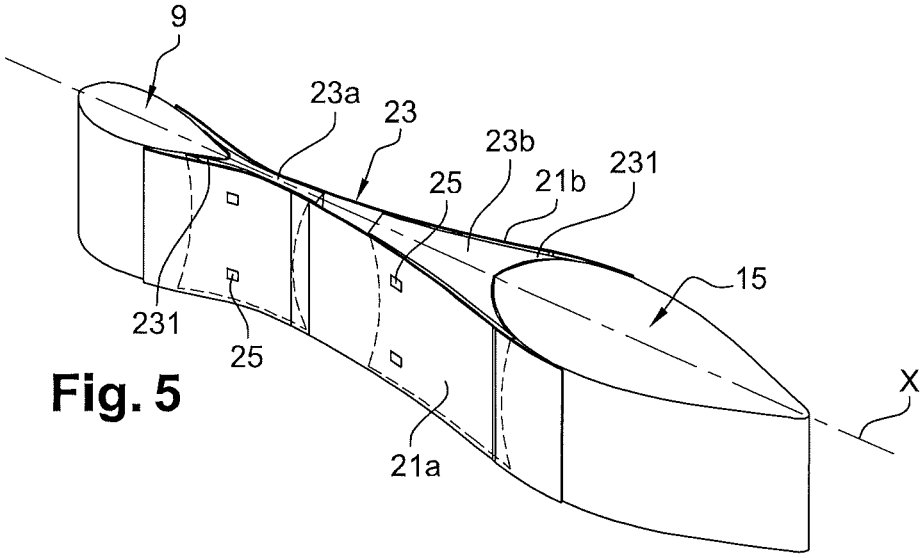
Figure 6:
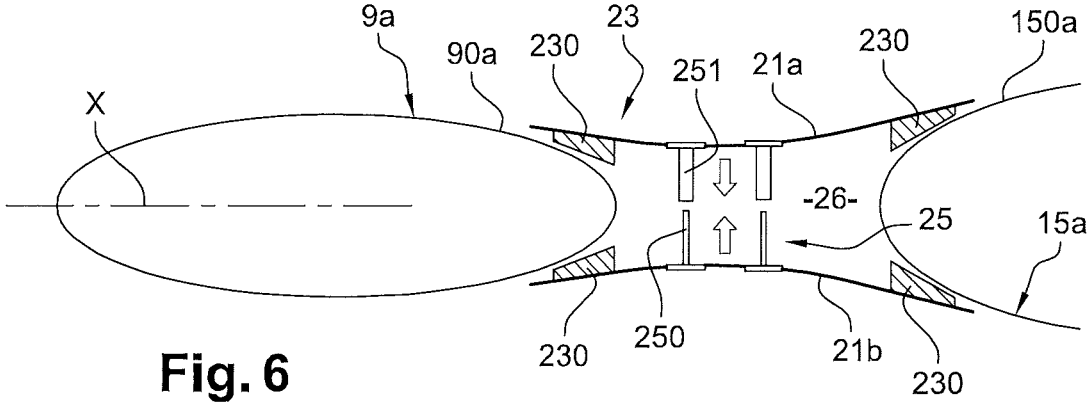

FIGS. 4, 5 schematically represent said first method of installation of the fairings, in a horizontal section and perspective, respectively, and FIG. 6 schematically represents said second method of installation of the fairings, in a horizontal section.

Figure 1:
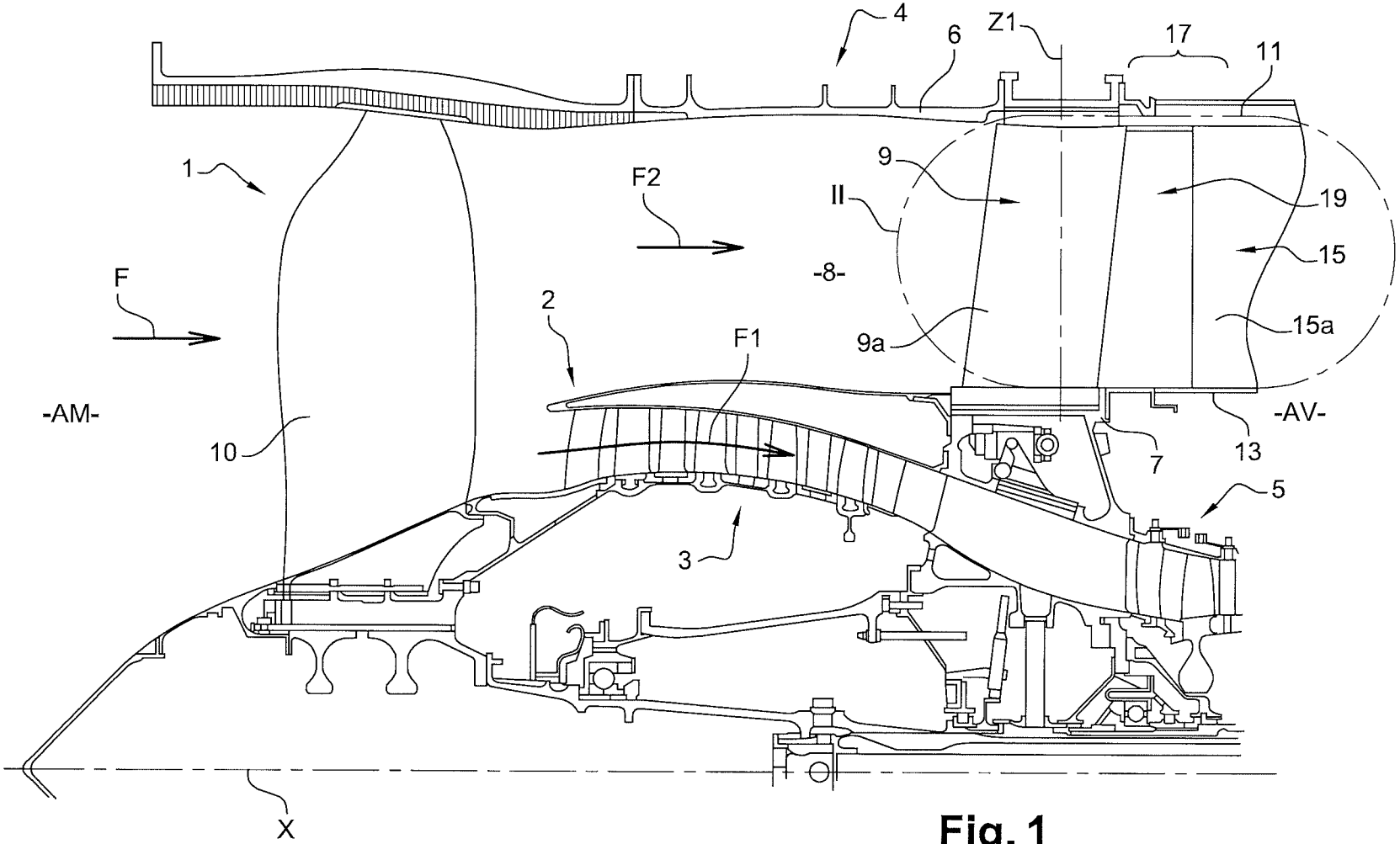
FIG. 1 is a schematic diagram, in median half section passing through the longitudinal X axis of the engine (axis of rotation), of an upstream part of a turbine engine.

FIG. 1 illustrates a turbine engine comprising, from upstream (AM) to downstream (AV), in the direction of the arrow F of a flow of fluid generally parallel to the X axis of rotation of the rotating vanes of this turbine engine, a fan 1, a flow separation nozzle 2, a low-pressure compressor 3, an intermediate casing 4, a high-pressure compressor 5, a combustion chamber, a high-pressure turbine and a low-pressure turbine (not visible).

In the present description, radially means radially to the X axis.

The fan 1 comprises rotating vanes, one of which is schematically represented 10.

The flow of air F entering the turbine engine is separated into a primary flow F1 which circulates inside the low- and high-pressure compressors 3, 5 and into a secondary flow F2 which by-passes the compressors 3, 5, the combustion chamber and the turbines.

The intermediate casing 4 comprises an external shroud 6 and an internal hub 7 delimiting a part of the secondary stream 8 in which the secondary fluid flow F2 circulates. The fluid flowing in the secondary stream is air propelled by the fan of the turbine engine.

The shroud 6 and the hub 7 are interconnected by radial structural arms 9 spaced circumferentially in relation to one another. These arms 9 possess high mechanical resistance allowing, on the one hand, transmission of the forces between the shroud 6 and the hub 7 and on the other hand, resistance to any projectiles liable to collide therewith. Furthermore, the arms 9 each have a profiled shape so as to fulfil an outlet guide vane (OGV) function, designed to redirect the secondary fluid flow F2 in order to limits its gyration.

A part further downstream of the stream 8 of secondary flow F2 which follows the intermediate casing 4 is radially delimited between respectively inner 11 and outer 13 casings.

These may be the inner fan duct (IFD) and outer fan duct (OFD) casings respectively.

These inner 11 and outer 13 casings are interconnected by radial arms 15 spaced circumferentially in relation to one another. Typically, slaving transfer arms, larger in size than the arms 9, will be involved.

Figure 2:
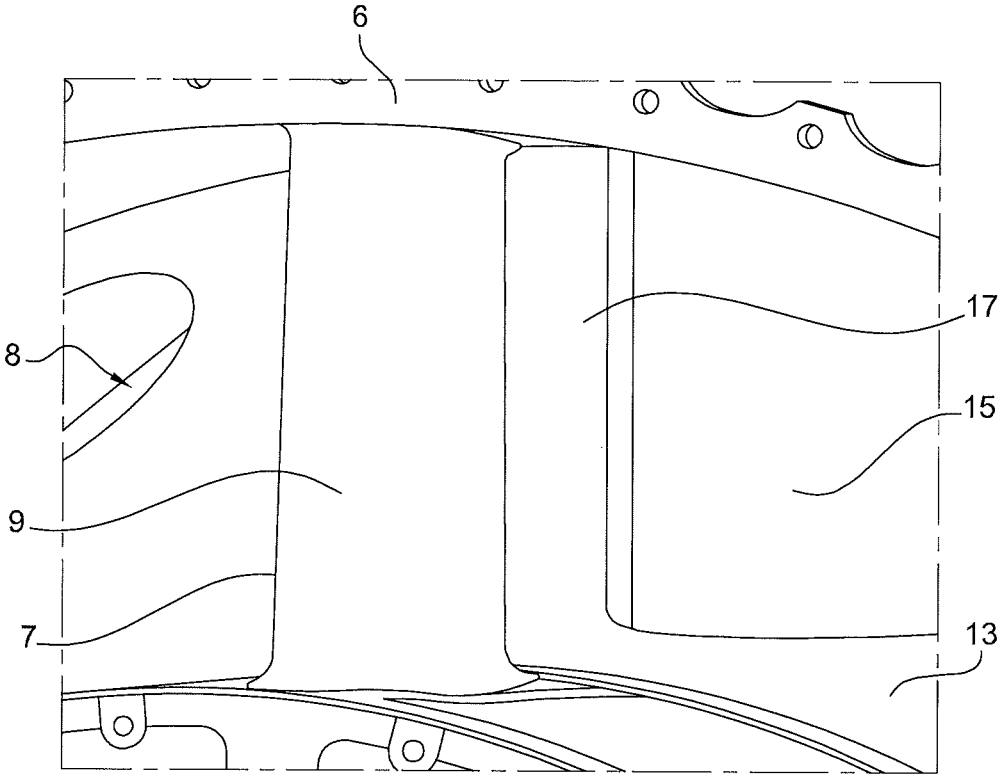
FIGS. 2 and 3 show two more local diagrams of area II in FIG. 1, in a perspective view, without the aerodynamic linking device between arms and with this device, in a side view, respectively.

FIG. 2 shows this area, with a radial arm 9 downstream from which a radial arm 15 extends with the same angular setting.

Streamlining the area 17 extending along the stream 8 between at least two radial arms 9*a*, 15*a* of the aforementioned two groups of arms 9 and 15 will promote the aerodynamic performances of this stream.

It has indeed been proven that the aerodynamic profile of the trailing edge 91 of the arm 9*a* of the intermediate casing (FIG. 3) did not allow addition of interface points without modifying the rough casting of the latter.

An aerodynamic linking device 19, as shown in FIG. 1 in particular, has therefore been arranged between these two arms 9*a*, 15*a* aligned along the stream 8 (refer to FIG. 4 X1 axis, substantially parallel to the X axis).

Each aforementioned arm and in particular each of the arms 9*a*, 15*a*, has an outer surface, in this case 90*a* and 150*a* respectively, in contact with the secondary flow F2; FIG. 4.

In order to perform this aerodynamic link function, the device 19 comprises fairings 21*a*, 21*b* extending between the two arms 9*a*, 15*a* and compressible interface means 23 interposed between the fairings, means 25 of retention holding the fairings in place by pressure in relation to the arms, by compressing the interface means 23.

Figure 3:
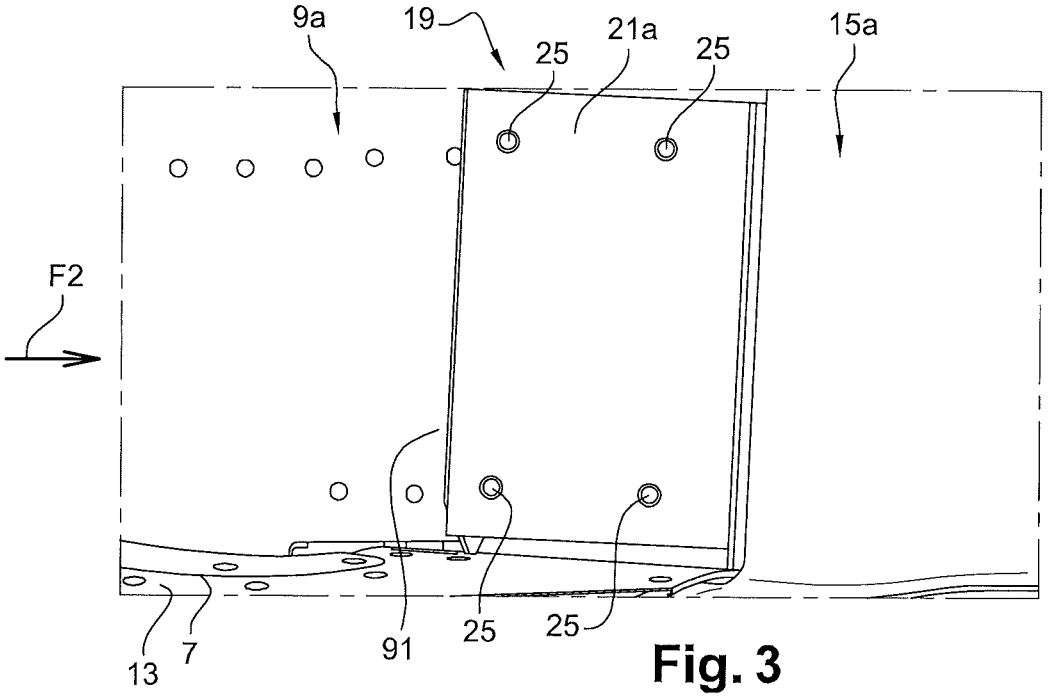

Not illustrated in FIG. 5, these means 25 of retention are schematically represented in FIGS. 3, 4 and 6. The latter will be returned to later.

As can be seen in the figures, it will be possible, by means of the aerodynamic linking device 19, for the fairings 21*a*, 21*b* to extend continuously between the two arms in question.

In practice, and as illustrated, what is known in this case as "the fairings 21*a*, 21*b*" will ensure material continuity and line continuity of fluid flow between the trailing edge 91 of the arm 9*a* and the leading edge of the arm 15*a*.

These fairings will favourably consist of a plate (if the latter was folded for example), or several plates (forming a kind of metallic skin) fixed together in this case. If there was only one plate folded into a V for example, the two free ends could be positioned closed to each other, thus trapping between them the compressible interface means 23, interposed in the space 17, between the arms.

An embodiment in a metal plate or plates will be the most likely solution.

Installed between arms of the intermediate casing 4 and of the casings 11 and 13 respectively, the fairings 21*a*, 21*b* will both have a tapered shape from the arm 9*a* towards the arm 15*a* (refer for example to 4), since transversally to the X/X1 axis and radial directions Z1 and Z2 (refer to FIGS. 1, 4) of these arms 9*a*, 15*a* respectively, the width I1 towards the trailing edge 91*a* of the arm 9*a* is less than the width I2 towards the leading edge 151*a* of the arm 15*a*. Hence, the second arm has a larger section than the first arm.

At axial ends, the fairings jointly cover on one side, the trailing edge 91*a* and on the other side, the leading edge 151*a*.

Furthermore, these fairings 21*a*, 21*b* will preferably have an external concavity, thereby promoting fluid flow between the external convexities of the arms 9*a* and 15*a*.

With regard to embodiment of the compressible interface means 23 interposed between the fairings, FIGS. 4-6 schematically represent several embodiments thereof.

In a first embodiment such as that in FIG. 4, between the two arms 9*a* and 15*a*, the fairings 21*a*, 21*b* are separated from each other by a space 26 having a thickness or a width I (variable in this case) in which the interface means 23 extend continuously, on either side of which the fairings are therefore arranged.

Hence, these interface means 23 appear here as a single block compressed according to this width, therefore transversally to the X/X1 axis, by the fairings 21*a*, 21*b*, via the means 25 of retention oriented according to the width I and passing through passages 27, 29 arranged in the fairings 21*a*, 21*b* and in the interface block 23.

These means 25 of retention may occur in the form of nut-bolt assemblies.

It will be noticed that in this embodiment, as in the others, the means 25 of retention by pressure will therefore be arranged away from the arms and therefore in the interval or space 17 separating the latter, thereby avoiding interference therewith.

Furthermore, by positioning the fairings closer to the X1 axis, it will be possible to encourage bending of the latter favourable to slight lateral separation, in areas 31, between the outer surfaces 90*a*, 150*a* of the arms and the fairings 21*a*, 21*b* towards their axial ends where the added fairings are liable to be under direct pressure (metal/metal) against the arms, as this contact may incur premature wear by friction.

In the second embodiment as in FIG. 5, the block forming the interface means 23 comprises several parts, in this case two parts 23*a*, 23*b* respectively attached to the arms 9*a* and 15*a*, wherein each has end shapes that may be profiled both towards the arms and the casings 11 and 13, thereby encouraging natural immobilisation of these parts in relation to their structural environment.

The means 25 of bringing the fairings closer to each other may still comprise nut-bolt assemblies.

It will be noted that in the first embodiment (FIG. 4), but this could also be applied to the second (FIG. 5), combining bringing closer transversally to the axis linking the arms (X1 axis in this case) with use of an elastically deformable material as interface means 23 will result in said positioning of the fairings 21*a*, 21*b* closer to each other, through said means for bringing closer 25, causing axial abutment of these interface means against the arms 9*a*, 15*a*; refer to the dash-dotted lines in FIG. 4 towards areas 91*a* and 151*a* and the areas marked 231 in FIGS. 4, 5.

In the third embodiment as in FIG. 6, the interface means 23 do not occupy the entire thickness between the lateral fairings 21*a*, 21*b*. They comprise in this case compressible skids 230 that are fixed, for example adhesively bonded, to the added fairings on the inner face of the latter.

Hence, these interface means are interposed between the fairings and the outer surfaces 90*a*, 150*a* of the arms.

To this end, the compressible skids 230 are positioned towards the respective axial ends of the fairings 21*a*, 21*b*.

They may not extend at all in the space 17 between the arms.

Their individual shape may taper towards the end next to which they are placed, as illustrated.

In this manner, the aforementioned direct pressure (metal/metal) against the arms will be avoided, while providing the desired aerodynamic link.

With regard to the fastening means 25, they may comprise bushes 250 with a threaded bore capable of being fixed to the inner wall of one of the two fairings. Tapped passages 251 for screws may be provided on the other fairing in order to bring the two fairings closer together by screwing in the screws into the associated bushes, which will compress the skids 230, thereby retaining the fairings in place in relation to the arms and casings.

In order to promote said retention of the fairings 21*a*, 21*b* and prevent their placement under direct pressure (metal/metal) fairings against the arms where the added fairings are liable to be, the interface means 23, which are compressible, will preferably be made of elastically deformable material, such as an elastomer.

Through the above solution and regardless of its embodiment, it will be easy to modify an area 17 between two arms in a stream of a turbine engine with a view therefore of increasing the aerodynamic performance of the stream.

The intervention method may be as follows:

Firstly, the aforementioned aerodynamic linking device 19 will be taken as a basis, with its fairings 21*a*, 21*b*, its compressible interface means 23 and their means 25 of retention in place by pressure in relation to the arms.

Next, the fairings will be arranged so as to extend while ensuring continuity of the aerodynamic lines between the two arms in question, such as 9*a*, 15*a*, around a part of said outer surfaces, by interposing the compressible interface means between the fairings 21*a*, 21*b*.

Subsequently, via the means of retention 25, tension will be applied to the fairings then retained in place by pressure in relation to said arms, by compressing the interface means 23.

Installation of the device 19 during maintenance will therefore be easy.

Particularly with compressible interface means 23 made of elastically deformable material, the thickness of these interface means 23 will be greater at rest (uncompressed means) in relation to the compressed state.

It will furthermore be noted that the present aerodynamic linking device 19 can also be implemented in order to produce a fairing such as that described in publication FR3025843A1, between the arms 11 and 13 which are shown therein, with a pivoting door scoop created in one of the two parts of the fairing. The configuration of the present supports or compressible interface means 23 and of the linking means 25 with retention of the two parts of the fairing is designed in this case to avoid causing any collision with opening of the door or with the sampling duct 14 mentioned in FR3025843A1.

The invention claimed is:

1. Part of a turbine engine, said part having an axis and comprising:

radially to said axis, an internal structural limit and an external structural limit which limit therebetween a stream of the turbine engine, a first arm and a second arm, each passing through said stream of the turbine engine in which stream the first arm, which is structurally distinct from the second arm, is disposed upstream from the second arm, the first arm connecting together the internal structural limit and the external structural limit, and, separately from the first arm, the second arm connecting together the internal structural limit and the external structural limit, and an aerodynamic linking device which comprises:

first and second fairings extending in the stream, between the first arm and the second arm, first compressible interface means and second compressible interface means, the first compressible interface means being interposed between the first and second fairings and the first arm, and the second compressible interface means being interposed between the first and second fairings and the second arm, and pressure retaining means for urging the first and second fairings towards each other which applies a pressure to the first and second arms, and which compress the first and second compressible interface means.

2. The part of a turbine engine of claim 1, wherein the pressure retaining means comprises means for bringing the first and second fairings closer to each other.

3. The part of a turbine engine of claim 2, wherein between the first and second arms arranged along said axis, the first and second fairings are separated from each other by a space having a width along which some at least of said first and second compressible interface means extend, such that bringing the first and second fairings closer to each other transversally to said axis, via said means for bringing the first and second fairings closer to each other, results in an axial abutment of the first and second compressible interface means against the first and second arms.

4. The part of a turbine engine of claim 1, wherein the first and second compressible interface means are interposed between the fairings and outer surfaces of the arms.

5. The part of a turbine engine of claim 1, wherein the first and second compressible interface means are made of elastically deformable material.

6. The part of a turbine engine of claim 5, wherein the elastically deformable material is an elastomer.

7. The part of a turbine engine of claim 1, wherein:

one of the first and second arms has a leading edge and a trailing edge and belongs to an intermediate casing of the turbine engine, thus extending radially between an internal hub and an external shroud, respectively corresponding to a first part of said internal and external structural limits and jointly delimiting a first part of said stream which is designed for passage of a secondary air flow in the turbine engine, the other of the first and second arms has a leading edge and a trailing edge and extends between an internal casing and an external casing of the turbine engine respectively corresponding to a second part of said internal and external structural limits and jointly delimiting a second part of said stream, and the second arm has a section larger than that of the first arm, and the first and second fairings run together flaring from the first arm to the second arm, jointly covering, at a first axial end, the trailing edge of the first arm and, at a second axial end, the leading edge of the second arm.

8. The part of a turbine engine of claim 1, wherein the first arm connects an internal hub of the turbine engine and an external shroud of the turbine engine, and wherein the second arm connects an internal casing of the turbine engine and an external casing of the turbine engine.

9. A method for modifying an area between a first arm and a second arm in a stream of a turbine engine having an axis, the stream being limited, radially to said axis, by an internal structural limit and an external structural limit, wherein each of the first and second arms has an outer surface, the first arm connecting together the internal structural limit and the external structural limit, and, separately from the first arm, the second arm connecting together the internal structural limit and the external structural limit, and wherein the method comprises stages in which:

an aerodynamic linking device is used comprising first and second fairings, first and second compressible interface means and pressure retaining means for retaining the first and second fairings in place by pressure in relation to the first and second arms, the first and second fairings are arranged so as to extend between the first and second arms, around a part of said outer surfaces, by interposing the first and second compressible interface means between the first and second fairings, and through the pressure retaining means, a stress is applied to the first and second fairings, which stress retains the first and second fairings in place by pressure in relation to the first and second arms, by compressing the first and second compressible interface means.

10. Part of a turbine engine having an axis and comprising:

two arms passing through a stream of the turbine engine, each of said two arms comprising an outer surface, and an aerodynamic linking device which comprises:

fairings extending in the stream, between the two arms;

compressible interface means interposed between the fairings; and pressure retaining means for retaining the fairings in place by pressure in relation to the arms, which compress the compressible interface means, wherein:

a first of the two arms has a leading edge and a trailing edge and belongs to an intermediate casing of the turbine engine, thus extending radially between an internal hub and an external shroud jointly delimiting a first part of a secondary stream designed for passage of a secondary air flow, and, a second of the two arms has a leading edge and a trailing edge and extends between an internal casing and an external casing of the turbine engine, jointly delimiting a second part of the secondary stream, the second arm having a section larger than that of the first arm, and the fairings running together flaring from the first arm to the second arm, jointly covering, at a first axial end, the trailing edge of the first arm and, at a second axial end, the leading edge of the second arm.

11. The part of claim 10, wherein, in said stream, the first arm is structurally separate from the second arm and disposed upstream from the second arm, parallel to said axis.

* * * * *